US011111618B2

(12) United States Patent
Gonzaga et al.

(10) Patent No.: US 11,111,618 B2
(45) Date of Patent: Sep. 7, 2021

(54) LAUNDRY TREATING APPLIANCE WITH REMOVABLE BASKET

(71) Applicant: WHIRLPOOL CORPORATION, Benton Harbor, MI (US)

(72) Inventors: Emmanuel F. Gonzaga, Rio Claro (BR); Fernando R. Martins, Rio Claro (BR)

(73) Assignee: Whirlpool Corporation, Benton Harbor, MI (US)

( * ) Notice: Subject to any disclaimer, the term of this patent is extended or adjusted under 35 U.S.C. 154(b) by 421 days.

(21) Appl. No.: 15/983,254

(22) Filed: May 18, 2018

(65) Prior Publication Data

US 2019/0352831 A1 Nov. 21, 2019

(51) Int. Cl.
*D06F 37/16* (2006.01)
*D06F 37/12* (2006.01)

(52) U.S. Cl.
CPC ..... *D06F 37/16* (2013.01); *D06F 37/12* (2013.01)

(58) Field of Classification Search
CPC ..... D06F 37/16; D06F 37/12
See application file for complete search history.

(56) References Cited

U.S. PATENT DOCUMENTS 3,014,358 A * 12/1961 Bochan ..... D06F 39/00 68/4
3,029,623 A * 4/1962 Morey ..... D06F 13/00 68/4
3,145,551 A * 8/1964 Ziegler ..... D06F 13/00 68/4
3,209,560 A * 10/1965 Shelton ..... D06F 13/00 68/4
3,324,688 A * 6/1967 Hubbard ..... D06F 13/00 68/4
3,481,162 A 12/1969 Ziegler
3,509,741 A * 5/1970 Morey ..... D06F 37/12 68/27
3,575,020 A * 4/1971 Hubbard ..... D06F 13/00 68/4
4,225,992 A * 10/1980 Morey ..... D06F 23/04 8/158
4,637,230 A * 1/1987 Roberts ..... D06F 29/00 68/18 FA
4,637,231 A * 1/1987 McMillan ..... D06F 33/00 68/4
2007/0074544 A1* 4/2007 Fields ..... D06F 39/00 68/235 R
2007/0084254 A1* 4/2007 Messina ..... D06F 95/002 68/142
2009/0211108 A1* 8/2009 Moschutz ..... D06F 58/30 34/491

(Continued)

*Primary Examiner* — Benjamin L Osterhout
(74) *Attorney, Agent, or Firm* — McGarry Bair PC

(57) ABSTRACT

A laundry treating appliance that has a first clothes mover and a removable basket assembly coupled to the first clothes mover. The removable basket assembly has a second wash basket and a second clothes mover. A first blocker is positioned between the second wash basket and the second clothes mover for stabilizing the second clothes mover relative to the second wash basket. A second blocker is positioned between the first clothes mover and the second wash basket for stabilizing the removable basket assembly relative to the first clothes mover.

19 Claims, 3 Drawing Sheets

(56) References Cited

U.S. PATENT DOCUMENTS

| | | | | |
|---|---|---|---|---|
| 2011/0094902 | A1* | 4/2011 | Delehey | D06F 95/002 206/216 |
| 2013/0115130 | A1* | 5/2013 | Kappler | D06F 58/203 422/5 |
| 2015/0059417 | A1* | 3/2015 | Ramasco | D06F 39/022 68/17 A |
| 2015/0184326 | A1* | 7/2015 | Seo | D06F 37/20 68/132 |
| 2015/0211163 | A1 | 7/2015 | Kim et al. | |
| 2016/0201243 | A1* | 7/2016 | Bergamo | D06F 37/12 8/137 |
| 2016/0222567 | A1 | 8/2016 | Ramasco et al. | |
| 2016/0289884 | A1* | 10/2016 | Kim | D06F 35/006 |

* cited by examiner

LAUNDRY TREATING APPLIANCE WITH REMOVABLE BASKET

BACKGROUND

Laundry treating appliances, such as clothes washers, refreshers, and non-aqueous systems, may have a configuration based on a rotating basket that defines a treating chamber in which laundry items are placed for treating. Some laundry treating appliances can also have a removable basket assembly having a second wash basket and a second clothes mover for washing multiple loads. Sometimes the removable basket assembly can wobble or be unstable during operation.

BRIEF SUMMARY

In one aspect, the disclosure relates to a laundry treating appliance that has a first clothes mover and a removable basket assembly coupled to the first clothes mover. The removable basket assembly has a second wash basket and a second clothes mover. A first blocker is positioned between the second wash basket and the second clothes mover for stabilizing the second clothes mover relative to the second wash basket. A second blocker is positioned between the first clothes mover and the second wash basket for stabilizing the removable basket assembly relative to the first clothes mover.

In another aspect, the disclosure relates to a method of stabilizing a removable basket assembly having a second wash basket and a second clothes mover mounted on a first clothes mover in a laundry treating appliance having a first wash basket and a first clothes mover. The method comprises the step of fitting a first blocker between the second wash basket and the second clothes mover for stabilizing the second clothes mover relative to the second wash basket. The method also comprises the step of fitting a second blocker onto the second wash basket and the first clothes mover for stabilizing the removable basket assembly relative to the first clothes mover.

DETAILED DESCRIPTION

Aspects of the disclosure relate to a laundry treating appliance including a dual-basket system including a lower basket and a removable basket assembly. A first treating chamber is formed by the lower basket and a second treating chamber is formed by a second basket in the removable basket assembly. The lower basket can comprise a first clothes mover and the removable basket assembly can comprise a second clothes mover. A transmitter can be used to operably couple the first clothes mover to the second clothes mover to impart movement from the first clothes mover to the second clothes mover. A first blocker can be positioned between the second clothes mover and a second basket associated with the removable basket assembly for stabilizing the second clothes mover relative to the second wash basket, and, a second blocker can be positioned between the first clothes mover and the removable basket assembly for stabilizing the removable basket assembly relative to the first clothes mover.

Figure 1:
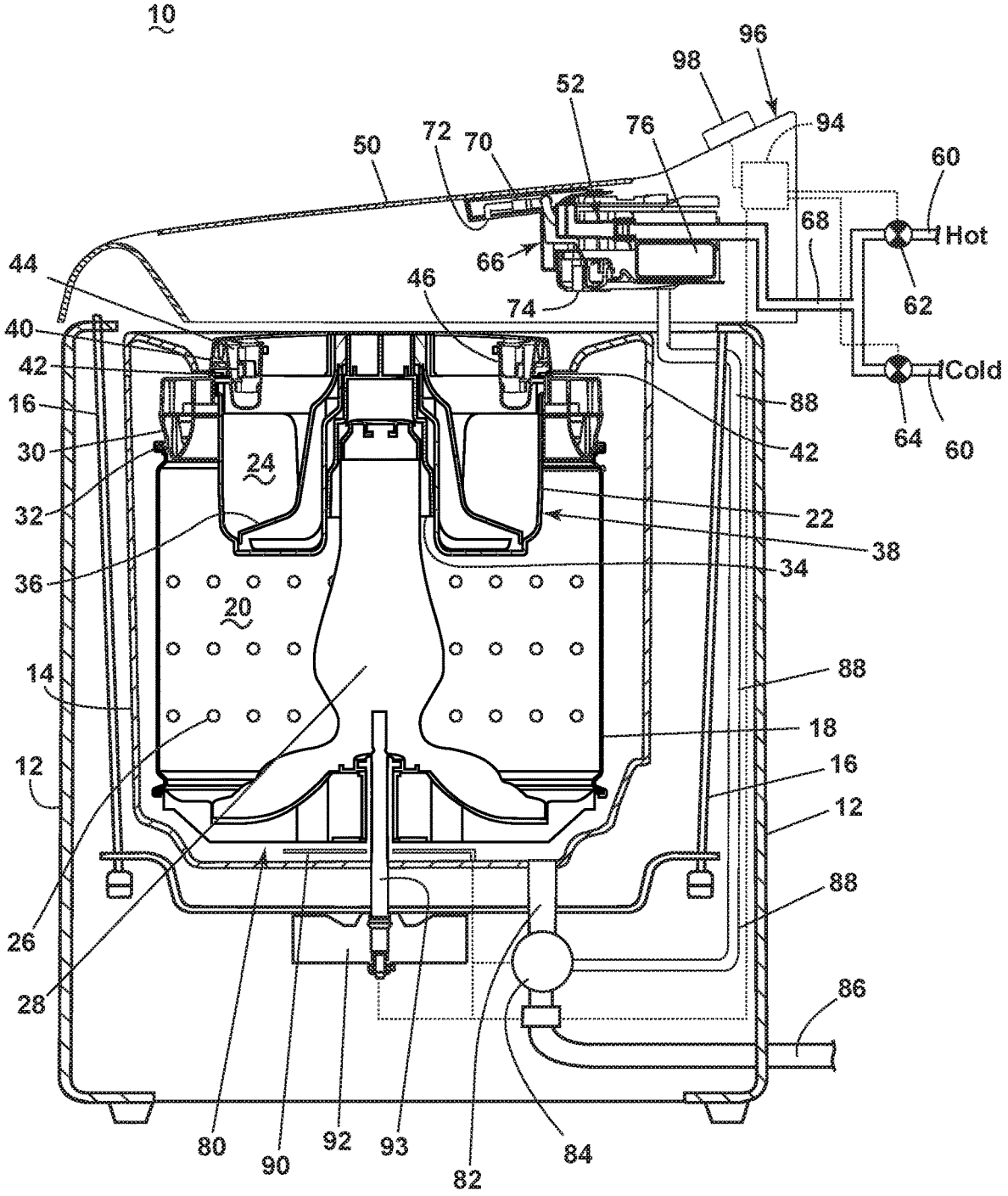
FIG. 1 is a schematic view of a laundry treating appliance in the form of a washing machine having a removable basket assembly and a lower basket with a first clothes mover.

Referring now to FIG. 1 a laundry treating appliance 10 can be any appliance which performs a cycle of operation to clean or otherwise treat items or articles placed therein, such as clothing laundry in one non-limiting example. The laundry treating appliance 10 is illustrated as a washing machine, which can include a structural support system comprising a cabinet 12 which defines a housing within which a laundry holding system resides. The cabinet 12 can be a housing having a chassis and/or a frame, defining an interior enclosing components typically found in a conventional washing machine, such as motors, pumps, fluid lines, controls, sensors, transducers, and the like. Such components will not be described further herein except as necessary for a complete understanding of the invention.

The laundry treating appliance 10 includes a tub 14 supported within the cabinet 12 by a suitable suspension system 16 for dynamically suspending portions of the laundry treating appliance 10 within the cabinet 12. A first basket 18 is provided within the tub 14 and defines a first treating chamber 20. The first basket 18 can include a plurality of perforations 26 such that liquid can flow between the tub 14 and the first basket 18 through the perforations 26. A first clothes mover 28 is provided within the first treating chamber 20 to move or agitate laundry articles received in the first treating chamber 20 according to a cycle of operation. Clothes mover as used herein can mean any suitable clothes mover to impart mechanical energy to a load of laundry, such as an agitator, mover, blade, impeller, or auger in non-limiting examples. A balance ring 30 can be provided along an upper edge 32 of the first basket 18.

A removable basket assembly 38 can include a second basket 22 that is at least partially provided within the first basket 18 and defines a second treating chamber 24. A transmitter 34 can be included in the removable basket assembly 38 and can removably attach to the first clothes mover 28. The transmitter 34 facilitates attachment and removal of the removable basket assembly 38 to and from the first clothes mover 28 to position the second basket 22 at least partially within the first treating chamber 20. A second clothes mover 36 is provided within the second basket 22 and is coupled with the first clothes mover 28 via the transmitter 34.

An upper ring 40 can be included in the removable basket assembly 38 and can operably couple to the second basket 22. The upper ring 40 can include an outer diameter that is greater than a diameter of the second basket 22. The upper ring 40 can extend at least partially over and seat upon the balance ring 30, such that the balance ring 30 can at least partially support the removable basket assembly 38 at the upper ring 40. A set of outlets 42 can be provided in the upper ring 40 to provide egress for liquid from the second basket 22. A set as used herein can include any number of elements, including only one. A detergent dispenser 44 and a fabric softener dispenser 46 can mount along the interior of the upper ring 40 and extend into the second treating chamber 24. Furthermore, the upper ring 40 can partially form the dispensers 44, 46. While the dispensers 44, 46 are described as specific to detergent and fabric softener, the dispensers 44, 46 can be used for dispensing any suitable treating chemistry into the second basket 22, which can be particular to a cycle of operation, including but not limited to water, enzymes, fragrances, stiffness/sizing agents, wrinkle releasers/reducers, softeners, antistatic or electrostatic agents, stain repellants, water repellants, energy reduction/extraction aids, antibacterial agents, medicinal agents, vitamins, moisturizers, shrinkage inhibitors, and color fidelity agents, and combinations thereof It should be appreciated that the removable basket assembly 38 is removable, such that the laundry treating appliance 10 can be used with or without the removable basket assembly 38. The balance ring 30 on the first basket 18 and the transmitter 34 coupled to the first clothes mover 28 are used to support the removable basket assembly 38.

The laundry treating appliance 10 can further include a door 50 which can be movably mounted to the cabinet 12 to selectively close the tub 14, the first basket 18, or the second basket 22. The laundry treating appliance 10 can further include a liquid supply system 52 for supplying water to the laundry treating appliance 10 for use in treating laundry during a cycle of operation. The liquid supply system 52 can include a source of water, such as a household water supply 60, which can include separate valves 62 and 64 for controlling the flow of hot and cold water, respectively. Water can be supplied to a liquid manifold 66 via a supply conduit 68. Optionally, one or more additional valves can be included on the supply conduit 68 to selectively provide water to the liquid manifold 66, or to tailor water temperature from the household water supply 60. A water dispenser 70, fluidly coupled to the liquid manifold 66, can mount to the door 50, for providing water to one or more of the first and second baskets 18, 22 via a first outlet 72. The water dispenser 70 can overhang above the first and second baskets 18, 22 such that water dispensed from the first outlet 72 can pass into the second basket 22 when using the removable basket assembly 38, or into the first basket 22 when the removable basket assembly 38 is not being used. A second outlet 74 can be provided on the liquid manifold 66 dedicated to the first basket 18. The second outlet 74 can be positioned outside of the second basket 22, such that any dispensed water will pass into the space between the tub 14 and the upper ring 40, passing into the first treating chamber 20, but not into the second treating chamber 24. The water dispenser 70 can be dedicated to the removable basket assembly and the second outlet 74 can be dedicated to the first basket 18; however, the laundry treating appliance 10 should not be so limited.

A dispenser 76 can be provided within or adjacent to the liquid manifold 66 and in fluid communication with the liquid manifold 66. The dispenser 76 can be used to dispense treating chemistry to the first basket 18 through the second outlet 74. Non-limiting examples of treating chemistries that can be dispensed by the dispensing system during a cycle of operation include one or more of the following: water, enzymes, fragrances, stiffness/sizing agents, wrinkle releasers/reducers, softeners, antistatic or electrostatic agents, stain repellants, water repellants, energy reduction/extraction aids, antibacterial agents, medicinal agents, vitamins, moisturizers, shrinkage inhibitors, and color fidelity agents, and combinations thereof.

The removable basket assembly 38 can further include coupling elements disposed on the periphery of the second basket 22. Such coupling elements can couple the removable basket assembly 38 to the first basket 18 and permit common rotation among the two. In one non-limiting example, the coupling elements can be similar to those as disclosed in U.S. Pub. No. 2016/0222567 to Ramasco et al., filed Oct. 23, 2015, now U.S. Pat. No. 9,863,078, issued Jan. 9, 2018, entitled "Coupling System of Removable Compartment for Appliances," which is herein incorporated by reference in full, and the removable basket assembly 38 can couple in the same manner as described therein.

The laundry treating appliance 10 can also include a recirculation and drain system for recirculating or draining liquid within the laundry treating appliance 10. Liquid supplied to the tub 14 typically enters a space between the tub 14 and the first basket 18 and can flow by gravity to a sump 80 formed in part by a lower portion of the tub 14. The sump 80 can also be formed by a sump conduit 82 that can fluidly couple the lower portion of the tub 14 to a pump 84. The pump 84 can direct liquid to a drain conduit 86, which can drain the liquid from the laundry treating appliance 10, or to a recirculation conduit 88, which can direct the liquid from the sump conduit 82 into the liquid manifold 66, which can be returned to one or more of the first or second treating chambers 20, 24. In this manner, liquid provided to the tub 14, with or without treating chemistry can be recirculated into either the first or second treating chambers 20, 24 for treating the laundry per one or more cycles of operation.

The liquid supply and/or recirculation and drain system can be provided with a heating system which can include one or more devices for heating laundry and/or liquid supplied to the tub 14, such as a sump heater 90, which can be used to heat the laundry and/or liquid within the tub 14 as part of a cycle of operation.

Additionally, the liquid supply, recirculation and drain system can differ from the configuration shown in FIG. 1, such as by inclusion of other valves, conduits, treating chemistry dispensers, sensors, such as water level sensors and temperature sensors, and the like, to control the flow of liquid through the laundry treating appliance 10 and for the introduction of more than one type of treating chemistry.

The laundry treating appliance 10 also includes a drive system for rotating the first and second baskets 18, 22 within the tub 14. The drive system can include a motor 92, which can be directly coupled with the first basket 18 and the first clothes mover 28 through a drive shaft 93 to rotate or reciprocate the first basket 18 or the first clothes mover 28 about a rotational axis during a cycle of operation. Additionally, the rotational movement of the first clothes mover 28 can be imparted to the second clothes mover 36 and rotational movement of the first basket 18 can be imparted to the second basket 22. The motor 92, in one non-limiting example, can be a brushless permanent magnet (BPM) motor. Other motors, such as an induction motor or a permanent split capacitor (PSC) motor, can also be used. The motor 92 can rotate the first basket 18 and the second basket 22 at various speeds in either rotational direction, and can reciprocate the first and second clothes movers 28, 36 within its respective basket.

The laundry treating appliance 10 also includes a control system for controlling the operation of the laundry treating appliance 10 to implement one or more cycles of operation. The control system can include a controller 94 located within the cabinet 12 and a user interface 96 that is operably coupled with the controller 94. The controller 94 operably couples to the liquid supply system 52 and the user interface 96. The user interface 96 is configured to receive input from a user and provide output to the user. Such input can be used to select a cycle of operation, for example, an output can include information related to the cycle of operation, such as status. The input can be communicated to the controller 94, indicative of and including instructions to execute the cycle of operation. The user interface 96 can include one or more knobs 98, dials, switches, displays, touch screens and the like for communicating with the user, such as to receive input and provide output. The user can enter different types of information including, without limitation, cycle selection and cycle parameters, such as cycle options.

The controller 94 can include the machine controller and any additional controllers provided for controlling any of the components of the laundry treating appliance 10. For example, the controller 94 can include the machine controller and a motor controller. It is contemplated that the controller 94 is a microprocessor-based controller that implements control software and sends/receives one or more electrical signals to/from each of the various working components to effect the control software.

The laundry treating appliance 10 can be operated with both the first basket 18 and the second basket 22, simultaneously, or can be operated with either the first basket 18 or the second basket 22 individually. When executing a cycle of operation within the first basket 18 without the removable basket assembly 38, the second basket 22, including the transmitter 34, can be removed from the laundry treating appliance 10. When using the removable basket assembly 38 alone, laundry articles need to be provided only in the second basket 22. In such an organization, the removable basket assembly 38 mounts on the first clothes mover 28. Rotational or reciprocating movement of the first clothes mover 28 is transferred to the second clothes mover 36 via the transmitter 34. When using both the first and second baskets 18, 22, the first basket 18 can be filled with laundry articles, then the removable basket assembly 38 installs over the first treating chamber 20, and the second basket 22 is filled with additional laundry articles. The reverse of the aforementioned process can be used to remove laundry articles after a cycle of operation has completed.

Figure 2:
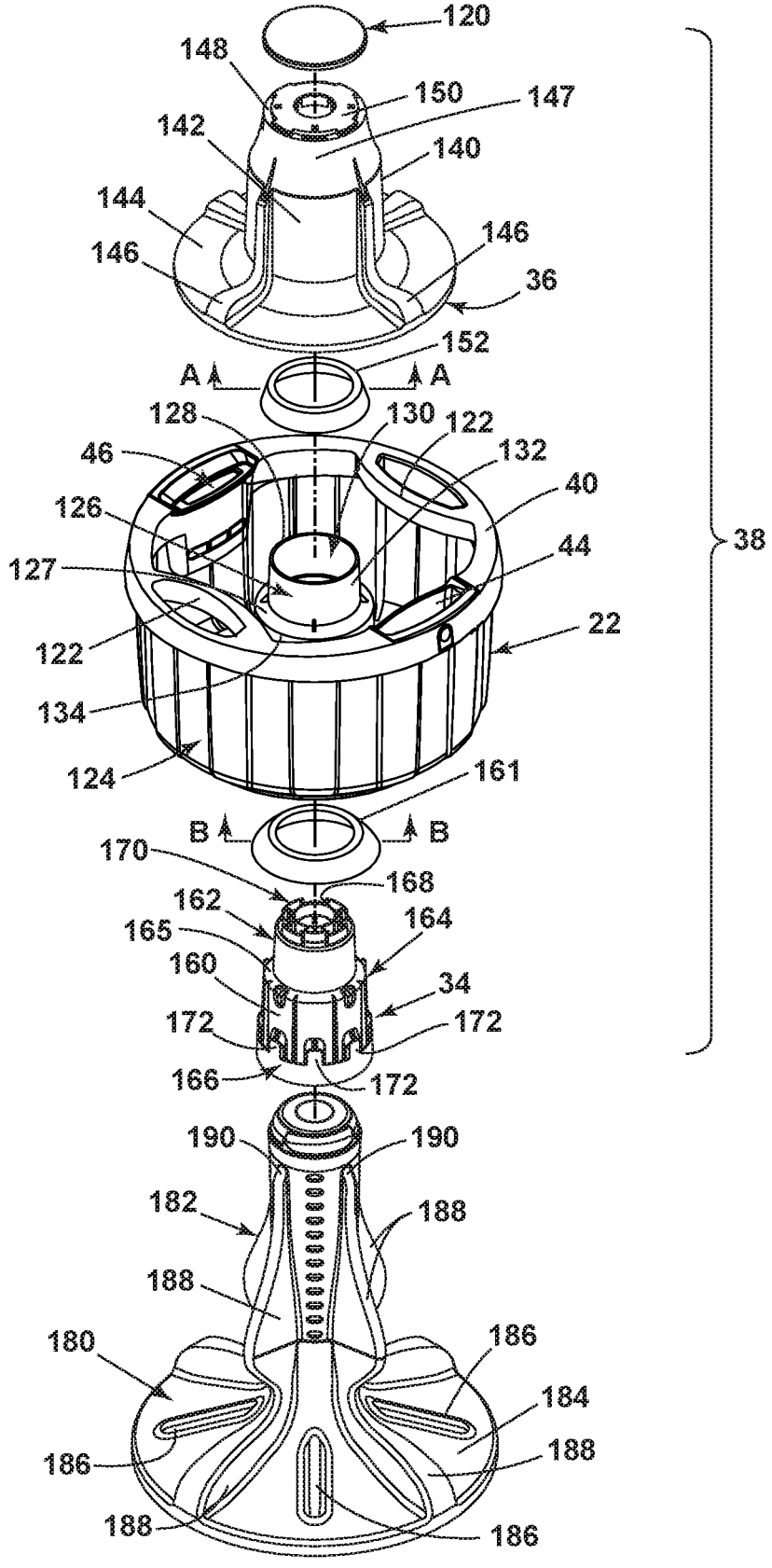
FIG. 2 is an exploded view of the removable basket assembly of FIG. 1 and the first clothes mover.

Referring now to FIG. 2 illustrating the removable basket assembly 38 in more detail, a cover 120 is included in the removable basket assembly 38. Two handles 122 can be provided in the upper ring 40, spaced between the first and second dispenser 44, 46. An exterior wall 124 can form the radial extent of the second basket 22. An interior wall 126 terminates at an upper edge 128 and can be separated into an upper portion 132 and a lower portion 134. A transition surface 127 transitions between the upper portion 132 and the lower portion 134. The transition surface 127 can be an angled wall as illustrated or could be any other shape that transitions from the larger diameter lower portion 134 to the smaller diameter upper portion 132. Relative to horizontal, it is contemplated that the transition surface 127 can be generally between 30 and 60 degrees to provide a smooth transition. A central aperture 130 is defined within the second basket 22 by the interior wall 126.

A clothes mover body 140 for the second clothes mover 36 includes a lower sidewall 142 transitioning into a bottom wall 144. A set of blades 146 can be provided on the clothes mover body 140 extending along at least a portion of the sidewall 142 and transitioning along the bottom wall 144. The lower sidewall 142 can transition to an upper sidewall 147. The upper sidewall 147 and be generally convex shaped and angled inward toward top wall 148, which can form an upper terminal edge for the upper sidewall 147. A female connector 150 can be provided on the top wall 148. The cover 120 can be adapted to couple to the second clothes mover 36 at the top wall 148 to cover a female connector 150. The sidewall 142, bottom wall 144, and the top wall 148 are sized to surround the interior wall 126 of the second basket 22, while remaining spaced from the upper edge 128 when assembled.

A first blocker 152 in the form of a ring can be positioned between the interior wall 126 of second basket 22 and the second clothes mover 36 located within the removable basket assembly 38. Since the second clothes mover 36 rotates relative to the second basket 22, the first blocker 152 must be able to freely rotate relative to one or the other. In other words, the first blocker 152 can be affixed to either an inside portion of the second clothes mover 36 or to an outside portion of the second basket 22 such as interior wall 126. In an exemplary configuration the first blocker 152 can be affixed to the inside surface of the second clothes mover 36 by snap fit, screws, clips of other fastening mechanisms. The first blocker 152 could also be integrally molded to the inside of the second clothes mover 36. It is contemplated that the first blocker 152 can be made from a plastic material or other durable material that does not wear easily due to friction. It should also be noted that the first blocker 152 does not have to be a 360 degree ring shape. Instead, the first blocker 152 could be a partial ring or spaded blocks.

A transmitter body 160 can form the transmitter 34, and can be arranged into an upper section 162, an intermediate section 164, and a lower section 166. A transition wall 165 transitions between the upper section 162 and the intermediate section 164. The transition wall 165 can be an angled wall as illustrated or could be any other shape that transitions from the larger diameter intermediate section 164 to the smaller diameter upper section 162. The transition wall 165 can also general be complimentary in shape to the transition surface 127 of second basket 22. Relative to horizontal, the transition surface 127 can generally be between 30 and 60 degrees to provide a smooth transition. An upper edge 168 forms the terminal end of the upper section 162. A male connector 170 can be provided on the upper edge 168 and is adapted to be received by the female connector 150 of the second clothes mover 36. It should be appreciated that the male connectors 170 and the female connector 150 on the second clothes mover 36 can be interchangeable, having one of the male or female connectors 150, 170 on the second clothes mover 36 and the other on the transmitter 34. The upper section 162 can be sized to fit within the interior wall 126 of the second basket 22. The intermediate section 164 can have a greater diameter than that of the upper section 162 and can transition into the upper section 162. The intermediate section 164 can be sized fit within the lower portion 134 of the second basket 22. The lower section 166 can have a diameter that is greater than that of the intermediate section 164 and can transition into the intermediate section 164. A set of protrusions 172 are formed in the lower section 166 extending toward the intermediate section 164.

A second blocker 161 in the form of a ring can be positioned between the transmitter 34, which couples to the first clothes mover 28, and the removable basket assembly 38. The second blocker 161 can be affixed to either an inside portion of the removable basket assembly 38 or to an outside portion of the transmitter 34. In an exemplary configuration the second blocker 161 can be affixed to an inside surface of the removable basket assembly 38 such as the inside surface of transition surface 127 by snap fit, screws, clips of other fastening mechanisms. The second blocker 161 could also be integrally molded to the inside of the removable basket assembly 38. It is contemplated that the second blocker 161 can be made from a plastic material or other durable material that does not wear easily due to friction. It should also be noted that the first blocker 152 does not have to be a 360 degree ring shape. Instead, the second blocker 161 could be a partial ring or spaded blocks.

The first clothes mover 28 can include a sidewall 182 and a bottom wall 184. A set of movers 186 are provided on the bottom wall 184 adapted to move laundry along the bottom wall 184. A set of blades 188 can be partially formed on the first clothes mover 28 extending from the bottom wall 184 along the sidewall 182 and provided between the movers 186. The blades 188 extend at least partially along the length of the first clothes mover 28, terminating at a set of blade ends 190.

In assembly of the removable basket assembly 38, the transmitter 34 can insert through the central aperture 130 of the second basket 22. The sizing of the upper portion 132 of the interior wall 126 can be complementary to the upper section 162 of the transmitter 34 to extend the male connector 170 beyond the upper edge 128 of the interior wall 126. Furthermore, the lower portion 134 can be sized to surround the intermediate and lower sections 164, 166, while the upper portion 132 includes a diameter that is too small to permit insertion of the intermediate and lower sections 164, 166. One point of contact between the removable basket assembly 38 and the transmitter 34 can be at the second blocker 161 such that second blocker 161 is positioned between and engages with or makes contact with the transmitter 34 and the removable basket assembly 38.

The second clothes mover 36 can insert over the interior wall 126 of the second basket 22. Removal of the upper ring 40 may be required to fit the second clothes mover 36 within the second basket 22. The clothes mover body 140 passes over the interior wall 126 until the male connector 170 is received in and coupled to the female connector 150. As the male connector 170 extends beyond the upper edge 128 of the interior wall 126, the second clothes mover 36 can be spaced within the second basket 22 such that the first blocker 152 is positioned between and engages with or makes contact with the second wash basket 22 and the second clothes mover 36. The cover 120 can mount to the second clothes mover 36 over the female connector 150. In a non-limiting example, the cover can secure to the second clothes mover 36 by way of press fit or weld.

In the spaced arrangement, unrestricted rotational or reciprocating movement of the second clothes mover 36 is possible within the second basket 22. Such connection of the removable basket assembly 38 can be fixed such that the transmitter fastens to the second clothes mover 36 through the second basket 22 and the cover fastens onto the female connector 150. The removable basket assembly 38 can then removably mount on the first clothes mover 28 as a single unit.

Figure 3:
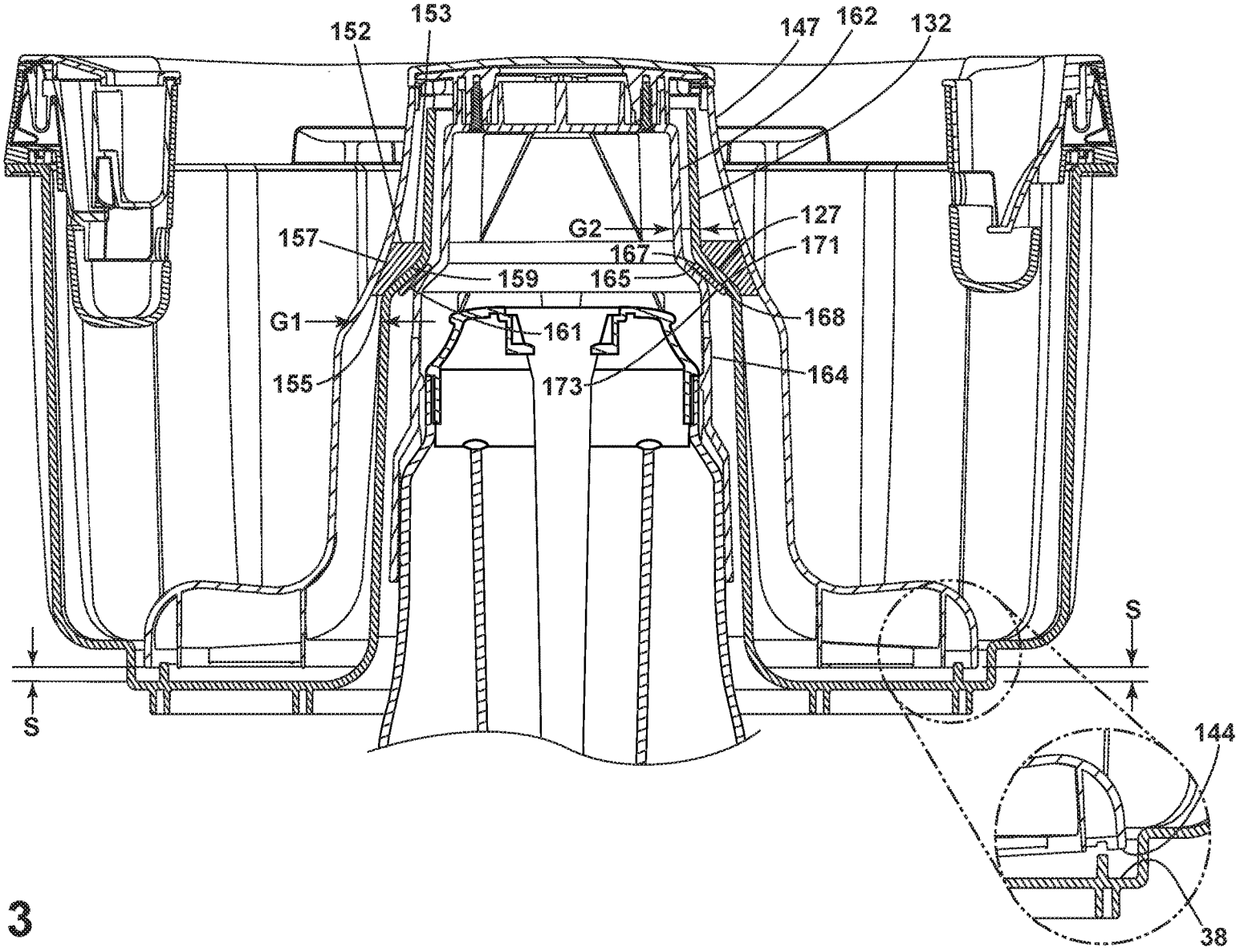
FIG. 3 is a side view of the removable basket assembly of FIG. 1 illustrating placement of a pair of blockers.

FIG. 3 illustrates an exemplary cross-section of the first and second blockers 152, 161 across cross-sectional lines A-A, B-B, respectively as shown in FIG. 2. The first blocker 152 can have an upper surface 153, lower surface 155, and side surfaces 157 and 159. Side surface 157 is contemplated to have a shape complimentary to the inside of the upper sidewall 147 of the second clothes mover 36. Side surface 159 is contemplated to have a shape complimentary to the outside portion of the transition surface 127 of the second basket 22. The upper surface 153 and lower surface 155 are designed with a thickness sufficient to fill gap $G_1$ so as to prevent wobbling of the second clothes mover 36 during operation. Similarly, the second blocker 161 can have an upper surface 167, lower surface 169, and side surfaces 171 and 173. Side surface 171 is contemplated to have a shape complimentary to the inside portion of the transition surface 127 of the second basket 22. Side surface 173 is contemplated to have a shape complimentary to the outside portion of the transition wall 165 of the transmitter 34. The upper surface 167 and lower surface 169 are designed with a thickness sufficient to fill gap $G_2$ so as to prevent wobbling of the removable wash basket 38 during operation.

FIG. 3 further illustrates exemplary positioning of the first and second blockers 152, 161, respectively. In the illustrated example, the first blocker 152 can be positioned between the upper sidewall 147 of the second clothes mover 36 and transition surface 127 of the second wash basket 22. The first blocker 152 fills gap $G_1$ to prevent the second clothes mover 36 from wobbling during operation. In other words, in the absence of first blocker 152, the second clothes mover 36 can be moved from side-to-side due to gap $G_1$. This wobbling or side-to-side movement of the second clothes mover 36 can cause separation S between the bottom wall 144 of the second clothes mover 36 and bottom of the removable basket assembly 38. The separation S can become sufficiently large, as illustrated in the blown up portion of the FIG. 3, which could allow clothes item in the treating chamber to jam or lodge between the bottom wall 144 of the second clothes mover 36 and bottom of the removable basket assembly 38. First blocker 152 prevents wobbling or side-to-side movement of the second clothes mover 36 relative to the removable basket assembly 38 by filling the gap $G_1$ so the separation S remains constant and thereby preventing clothes item in the treating chamber to jam or lodge between the bottom wall 144 of the second clothes mover 36 and bottom of the removable basket assembly 38. It should be recognized that the exemplary placement of the first blockers 152 is for illustration purposes. The first blocker 152 could be positioned in many locations between the second wash basket 22 and second clothes mover 36 to prevent wobbling of the second clothes mover 36 relative to the second wash basket 22.

Additionally, the second blocker 161 can be positioned between the transition wall 165 of the transmitter 34 and the inside transition surface 127 of the second wash basket 22. The second blocker 161 fills gap $G_2$ to prevent the removable wash basket 38 from wobbling during operation. Preventing wobbling of the removable wash basket 38 relative to the first clothes mover 28 increases stability of the removable wash basket 38 during operation. It should be recognized that the exemplary placement of the second blocker 161 is for illustration purposes. The second blocker 161 could be positioned in many locations between the transmitter 34 and second wash basket 22 and still prevent wobbling of the removable wash basket 38 relative to the first clothes mover 36.

To the extent not already described, the different features and structures of the various embodiments may be used in combination with each other as desired. That one feature may not be illustrated in all of the embodiments is not meant to be construed that it cannot be, but is done for brevity of description. Thus, the various features of the different embodiments may be mixed and matched as desired to form new embodiments, whether or not the new embodiments are expressly described.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention, which is defined in the appended claims.

What is claimed is:

1. A laundry treating appliance comprising:

a first wash basket;

a first clothes mover coupled to the first wash basket;

a removable basket assembly coupled to the first clothes mover and comprising a second wash basket and a second clothes mover;

a first blocker positioned between the second wash basket and the second clothes mover for stabilizing the second clothes mover relative to the second wash basket; and a second blocker positioned between the first clothes mover and the second wash basket for stabilizing the removable basket assembly relative to the first clothes mover.

2. The laundry treating appliance of claim 1 further comprising a transmitter coupled to a top of the first clothes mover.

3. The laundry treating appliance of claim 2 wherein the transmitter comprises a transition wall.

4. The laundry treating appliance of claim 3 wherein the second wash basket comprises a transition surface.

5. The laundry treating appliance of claim 4 wherein the second wash basket transition surface is complementary in shape to the transmitter transition wall.

6. The laundry treating appliance of claim 5 wherein the second blocker is positioned between the second wash basket transition surface and the transmitter transition wall.

7. The laundry treating appliance of claim 1 wherein the second blocker is snap fit into the second wash basket.

8. The laundry treating appliance of claim 1 wherein the first blocker is formed from plastic.

9. The laundry treating appliance of claim 1 wherein the first blocker is a ring.

10. The laundry treating appliance of claim 1 wherein the second clothes mover comprises a generally convex upper sidewall and the second wash basket comprises a transition surface.

11. The laundry treating appliance of claim 10 wherein the first blocker comprises a side surface complementary in shape to the generally convex upper sidewall.

12. The laundry treating appliance of claim 11 wherein the first blocker comprises a side surface complementary in shape to the transition surface on the second wash basket.

13. The laundry treating appliance of claim 12 wherein the first blocker is positioned between the transition surface on the second wash basket and the generally convex upper sidewall.

14. The laundry treating appliance of claim 1 wherein the first blocker is snap fit to the second clothes mover.

15. The laundry treating appliance of claim 14 wherein the first blocker rotates on the second wash basket.

16. The laundry treating appliance of claim 1 wherein the second blocker is a ring.

17. A laundry treating appliance comprising:

a first wash basket;

a first clothes mover coupled to the first wash basket;

a transmitter coupled to the first clothes mover;

a second wash basket coupled to the transmitter;

a second clothes mover coupled to the second wash basket;

a first blocker positioned between the second wash basket and the second clothes mover for stabilizing the second clothes mover relative to the second wash basket; and a second blocker positioned between the transmitter and the second wash basket for stabilizing the second basket relative to the first clothes mover.

18. The laundry treating appliance of claim 17 wherein the second wash basket comprises a transition surface between 30 and 60 degrees relative to horizontal.

19. The laundry treating appliance of claim 18 wherein the first blocker has a wall complementary in shape to the transition surface such that the wall of the first blocker mounts over the transition surface when the second clothes mover is mounted on second wash basket.

* * * * *